US006205090B1

(12) United States Patent
Blount et al.

(10) Patent No.: US 6,205,090 B1
(45) Date of Patent: Mar. 20, 2001

(54) AUTOMATICALLY CORRECTABLE CLOCK

(75) Inventors: Rodney K. Blount, 7128 Long, Shawnee, KS (US) 66216; Rex A. Darrow, Shawnee, KS (US)

(73) Assignee: Rodney K. Blount, Shawnee, KS (US)

( * ) Notice: Subject to any disclaimer, the term of this patent is extended or adjusted under 35 U.S.C. 154(b) by 0 days.

(21) Appl. No.: 09/395,539

(22) Filed: Sep. 14, 1999

(51) Int. Cl.[7] ..... G04C 13/04
(52) U.S. Cl. ..... 368/52
(58) Field of Search ..... 368/52–59, 43

(56) References Cited

U.S. PATENT DOCUMENTS

| | | | | |
|---|---|---|---|---|
| 3,643,420 | * | 2/1972 | Haydon | 368/59 |
| 4,490,050 | * | 12/1984 | Singhi | 368/46 |
| 4,956,826 | | 9/1990 | Coyman et al. . | |
| 5,282,180 | * | 1/1994 | Burke et al. | 368/46 |
| 5,442,599 | * | 8/1995 | Burke et al. | 368/59 |

* cited by examiner

*Primary Examiner*—Bernard Roskoski
(74) *Attorney, Agent, or Firm*—Hovey, Williams Timmons & Collins

(57) ABSTRACT

A self adjusting clock system operable to provide a uniform time display on clocks throughout a facility including a master time-keeper, a plurality of slave time-keepers, and a time-keeping correction apparatus for correcting time of the slave time-keepers in accordance with the master time-keeper. The master time-keeper keeps the correct time and is operable to generate a master signal representative of a time correction. This master signal is then received by the time-keeping correction apparatus and analyzed in combination with other applicable information. The time-keeping correction apparatus supplies a slave correction signal to the slave time-keepers. The slave time-keepers independently keep and display the slave time-keeper time and respond to the slave correction signal to correct their slave time-keeper time when it deviates from the correct time kept by the master time-keeper. The time-keeping correction apparatus is operable to receive the master signal from the master time-keeper, analyze the master signal and supply the slave correction signal to the slave time-keepers.

23 Claims, 3 Drawing Sheets

AUTOMATICALLY CORRECTABLE CLOCK

BACKGROUND OF THE INVENTION

1. Field of the Invention

The present invention relates to time keeping devices, and more particularly, to a time-keeping correction apparatus for correcting time in a slave time-keeper in accordance with a master time-keeper.

2. Description of the Prior Art

Many organizations, such as schools, businesses, hospitals and other facilities where occupants wish to be uniformly informed of correct time for scheduling purposes, install and operate multiple clocks that all display a same time. Unfortunately, the time displayed on these clocks often deviates because of such events as a general or local power interruption, daylight savings time adjustments, or clock malfunctioning.

To compensate for these deviations so as to synchronize displays of all clocks in a facility, many organizations install self adjusting clock systems including a "master" clock that keeps the correct time and a plurality of individual "slave" clocks located throughout the facility. The master clock provides a control signal to the slave clocks to correct for any deviations in the displayed times.

Prior art self-adjusting clock systems suffer from several drawbacks. For example, analog slave clocks have previously been designed to only provide one method of correction. However, several correction methods exist to correct the time on slave clocks connected to the master clock. This makes it difficult to replace one or more of the slave clocks, because a slave clock would have to be found that provided the particular method of correction used by the master clock.

Prior art self adjusting clock systems are also inaccurate. In some traditional master/slave clock methods, the master clock sends a correction pulse to the slave clocks. After receiving the correction pulse or pulses, the slave clocks advance to a predetermined position based on the correction signal until they strike a mechanical stop. This method does not account for time that lapses while the hands are moved to the new position. Therefore, the time shown on the slave clocks is inaccurate even after the correction sequence.

Prior art self-adjusting clock systems also cannot "remember" the position of the hands during a power outage. By lacking capability of retaining such positional information, previous systems have relied on various sensors to determine the position of hands or have used a system of mechanical stops to establish hand positions.

Additionally, existing self-adjusting clock systems lack local fast forwarding capabilities for their analog slave clocks. This is not desirable as a user may wish to fast forward the position of the hands of a particular clock to a chosen time.

SUMMARY OF THE INVENTION

The present invention solves the above-described problems and provides a distinct advance in the art of time keeping devices. More particularly, the present invention provides a time-keeping correction apparatus for correcting time of an analog slave clock in accordance with a master time-keeper that allows a user to select from a plurality of correction schemes; that takes into account the time required for the hands of the slave time-keeper to move to the new time; that saves and updates the position of the hands of the slave time-keeper; and that allows a user to locally, manually fast forward an analog slave time-keeper.

The time-keeping correction apparatus of the present invention is part of a self-adjusting clock system and may be utilized in a slave time-keeper, or may be a stand-alone device. The time-keeping correction apparatus broadly includes an input port for receiving a master signal representative of a time correction from a master time-keeper; a selector for permitting a user to select a correction scheme from among a plurality of correction schemes; circuitry coupled with the input port and the selector for analyzing the master signal in accordance with the selected correction scheme and for developing a slave correction signal to be sent to the slave time-keeper; and an output coupled with the circuitry for sending the slave correction signal to the slave time-keeper.

In another embodiment, the time-keeping correction apparatus broadly includes an input port for receiving a master signal representative of a time correction from the master time-keeper, correction software resident in the time-keeping correction apparatus and including a code segment for representing a current position of hands of the slave time-keeper, circuitry coupled with the input port for analyzing the master signal and the code segment, for calculating a quantity of time to advance the time of the slave time-keeper, for incrementing the quantity of the time to advance the slave time-keeper in order to adjust for a passage of time during a correction cycle, and for developing a slave correction signal representative of the quantity of time to be sent to the slave time-keeper; and an output coupled with the circuitry for sending the slave correction signal to the slave time-keeper.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

Figure 1:
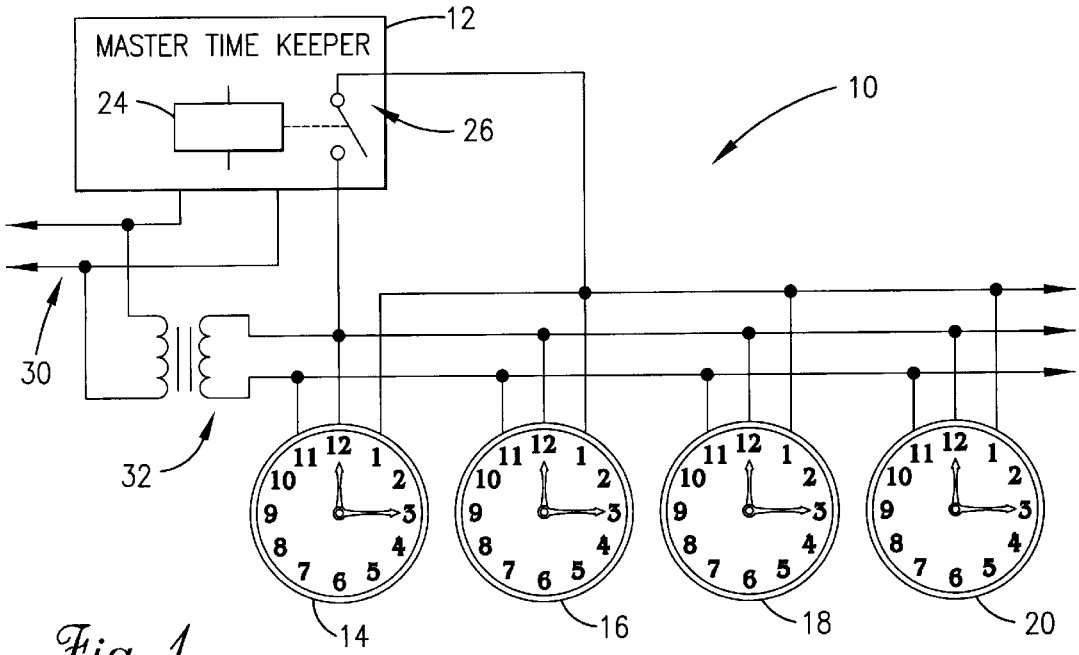
FIG. 1 is a schematic diagram illustrating a self-adjusting clock system constructed in accordance with a preferred embodiment of the present invention.

Referring to the drawing figures and particularly FIG. 1, a self-adjusting clock system 10 constructed in accordance with a preferred embodiment of the present invention is illustrated. The clock system 10 is operable to provide a uniform time display on clocks throughout a facility such as a school, business, or hospital and broadly includes a master time-keeper 12, a plurality of slave time-keepers 14,16,18, 20, and a time-keeping correction apparatus 22 (FIG. 2) for correcting time of the slave time-keepers 14,16,18,20 in accordance with the master time-keeper 12.

The master time-keeper 12 keeps the correct time and is operable with a signal generator 24 to generate a master signal 26 representative of a time correction. This master signal 26 is then received by the time-keeping correction apparatus 22 and analyzed in combination with other applicable information. The time-keeping correction apparatus supplies a slave correction signal 28 (FIG. 2) to the slave time-keepers.

The master time-keeper 12 may be powered by different voltages, the preferred voltage 30 is 120 volts alternating current. The master time-keeper 12 may be of many different types, the preferred embodiment being a Faraday Model 1462 Master Clock. The master time-keeper 12 can be mounted in many different locations in the facility, but is typically mounted in a central location such as a wiring or telecommunications closet so that it can easily be wired to the slave time-keepers.

The slave time-keepers independently keep and display the time and respond to the slave correction signal to correct their displayed time-keeper time when their displayed time deviates from the master time-keepers correct time. The slave time-keepers 14, 16, 18 20 may be powered by different voltages, the preferred voltage 32 is 24 volts alternating current. The slave time-keepers 14, 16, 18, 20 may be of many different types, the preferred embodiment being a low voltage stepper motor driven analog clock using a quartz crystal oscillator and having an hour, a minute and a second hand that travel in a rotational manner to indicate the time. The slave time-keepers 14, 16, 18, 20 can be mounted in various locations in the facility, most typically in the areas of highest occupancy in the facility.

The time-keeping correction apparatus 22 is coupled between the master time-keeper 12 and the slave time-keepers 14, 16, 18, 20 and is operable to receive the master signal 26 from the master time-keeper 12, analyze the master signal 26 and supply the slave correction signal 28 (FIG. 2) to the slave time-keepers 14, 16, 18, 20 with which they are coupled. The time-keeping apparatus 22 can be mounted in many different locations, but is preferably positioned internal to the housing of each slave time-keeper 14, 16, 18, 20 so that each one of the slave time-keepers 14, 16, 18, 20 has an associated time-keeping correction apparatus 22.

Figure 2:
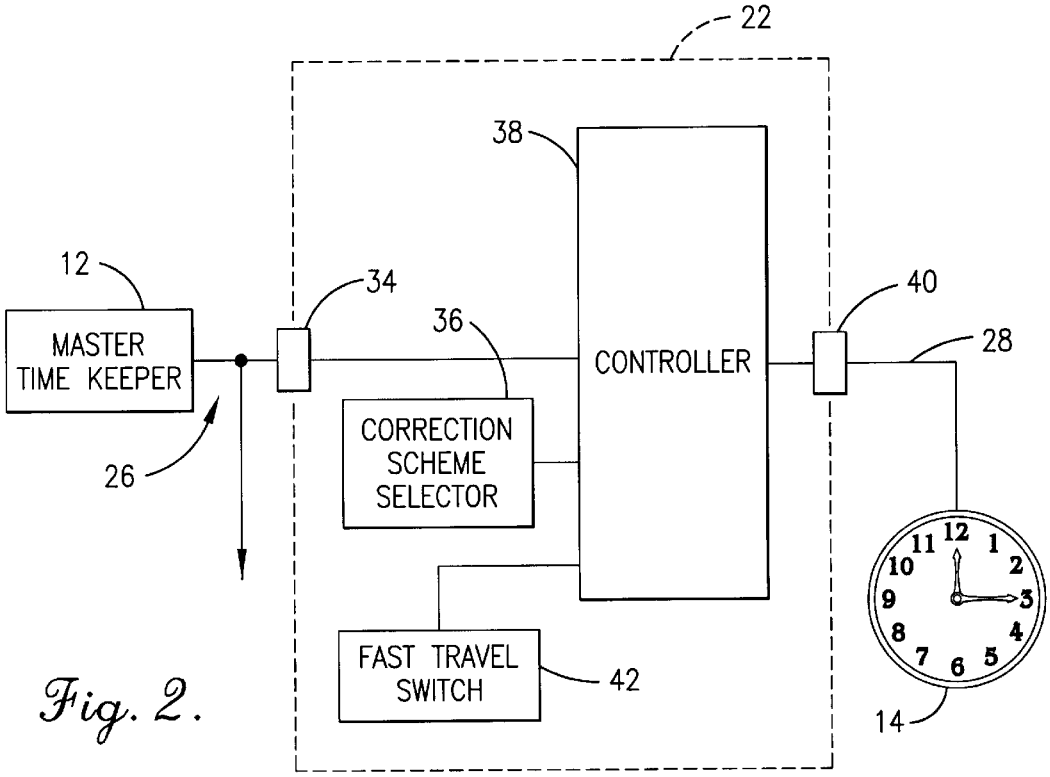
FIG. 2 is a schematic diagram of the self-adjusting clock system depicting the components of the time-keeping correction apparatus in more detail.

As shown in FIG. 2, each time-keeping correction apparatus broadly includes an input port 34, a correction scheme selector 36, circuitry including a controller 38 coupled with the input port 34 and the selector 36, and an output 40. FIG. 2 illustrates a schematic diagram of the components of the time-keeping correction apparatus 22 constructed in accordance with a preferred embodiment of the present invention.

In more detail, the input port 34 is configured for receiving the master signal 26 from the master time-keeper 12. The input port 34 may be of many different varieties, but the preferred embodiment is a hardwired connection.

The correction scheme selector 36 is a device for permitting a user to select a correction scheme from among a plurality of correction schemes. The selector 36 can be any type of selection device, such as a plurality of switches or relay devices. The preferred selector is a dual inline package switch.

In accordance with one aspect of the present invention, the controller 38 is coupled with the input port 34 and the selector 36 for analyzing the master signal 26 in accordance with the selected correction scheme and for developing a slave correction signal 28 to be sent to the slave time-keeper 14. (FIG. 2 illustrates one slave time-keeper 14 with one time-keeping correction apparatus) The preferred controller is a micro controller (Microchip 16LC715-04/P).

The output 40 is coupled with the controller 38 for sending the slave correction signal 28 to the slave time-keeper 14. The output 40 could be of a variety of physical connections. The preferred output is internal to the circuitry of the time-keeping correction apparatus and includes printed circuit card connections from a Texas Instruments 74AC125 driver/buffer.

Figure 3:
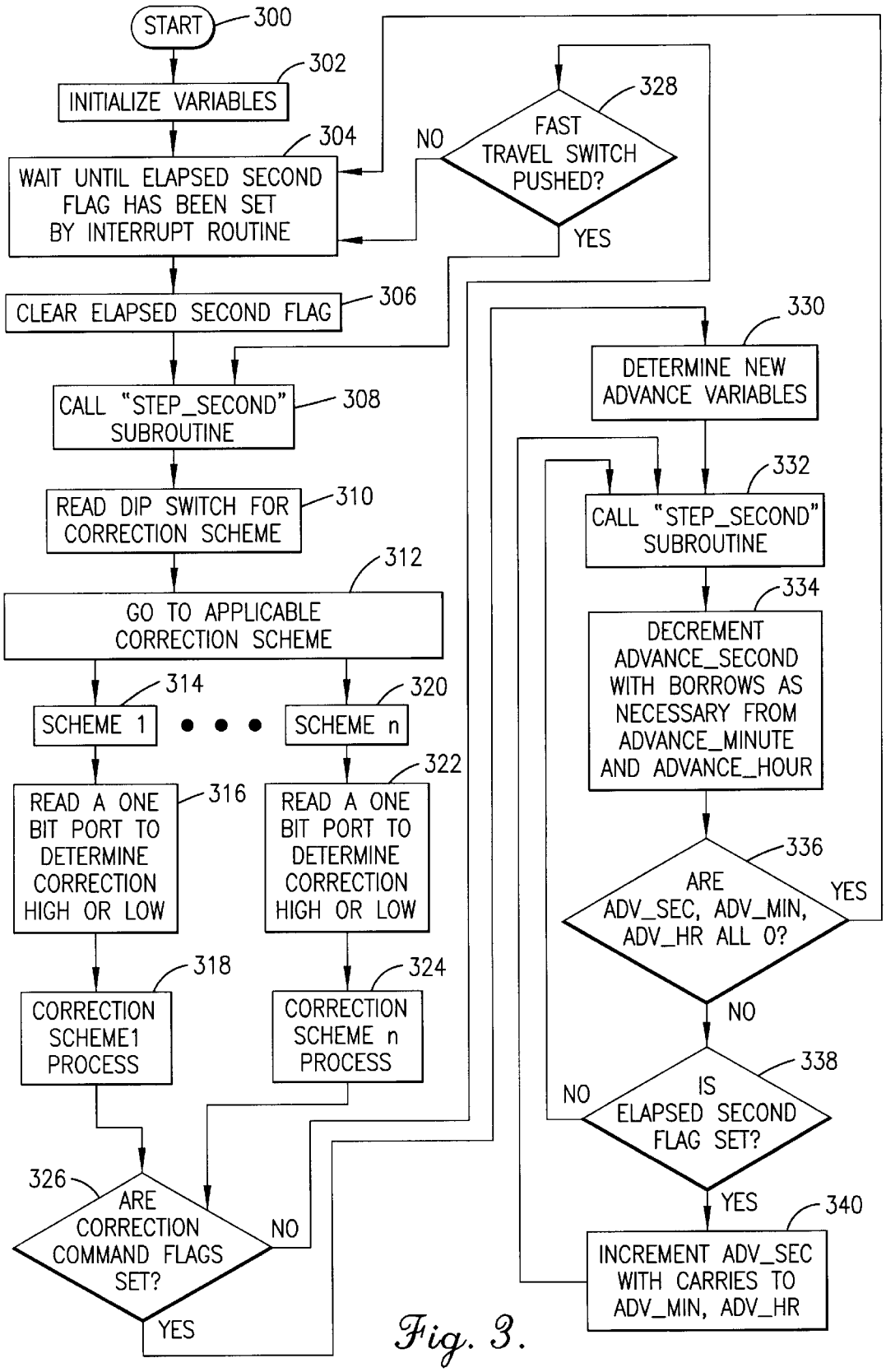
FIG. 3 is a flow diagram generally depicting the steps performed while operating the time-keeping correction apparatus.

The operation of the time-keeping correction apparatus 22 is generally depicted in the flow diagram of FIG. 3. Step 300 represents the initiation of the operation. Step 302 represents functions generally performed during manufacturing. The hands of the slave time-keeper 14 are set at a prescribed manually-placed starting position during or after manufacturing. Step 302 also initializes variables such as the value for the Present_Second, the Present_Minute and the Present_Hour. An additional variable that is initialized at this beginning point is the value in a pass counter. At this point, the pass counter would be set to 0.

Step 304 represents the beginning of a timekeeping procedure. During a normal timekeeping procedure, step 304 would be encountered in every second of time. It must be realized that the electronics have the ability to operate much faster than a stepper motor must operate in order to advance the slave time-keeper 1 second. Therefore, step 304 in the timekeeping sequence waits until an elapsed second flag has been set by an Interrupt Routine.

Figure 4:
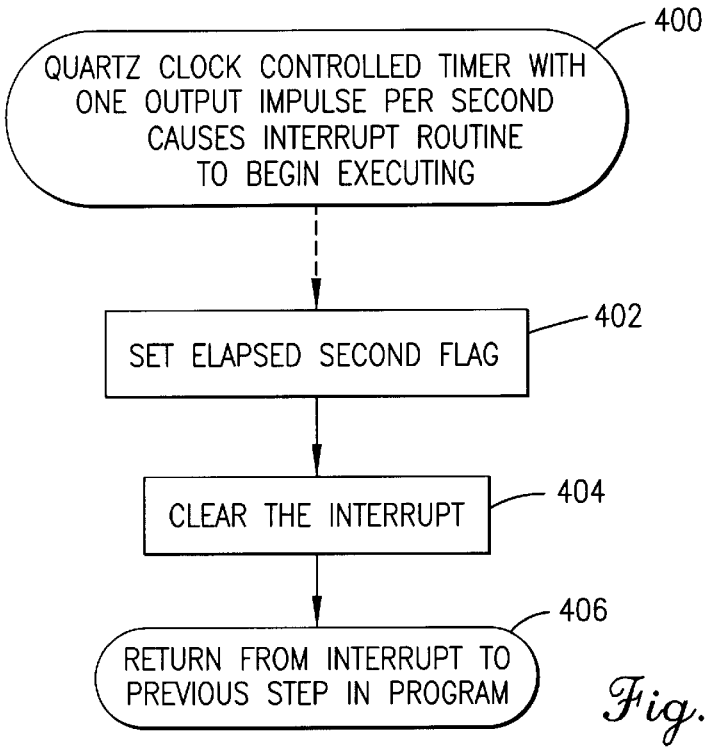
FIG. 4 is a flow diagram generally depicting the steps performed while operating the Interrupt Routine of the time-keeping correction apparatus.

FIG. 4 depicts the Interrupt Routine. Step 400 in the Interrupt Routine indicates the controlled output of a crystal oscillator. The crystal oscillator oscillates at a much higher speed than 1 oscillation per second. Therefore, it is necessary to feed the output of the crystal oscillator into the controller 38 of the time-keeping correction apparatus 22. The controller 38 contains divider circuits which are used to break down the crystal oscillator output to one pulse per second. Continuing in the Interrupt Routine, step 402 depicts that this 1 impulse per second then sets a memory bit used as an elapsed second flag. Step 404 clears the interrupt. Step 406 returns control from the Interrupt Routine back to the original procedure as depicted in FIG. 3 and proceeds to step 306.

Step 306 clears the elapsed second flag that was set in step 402 of the Interrupt Routine of FIG. 4. The flag representing the passing of one second must be cleared at this time in order to allow for the next operation of the Interrupt Routine to set the flag thus getting ready for the advance of the slave time-keeper for another second. In essence, the second flag operates with a toggle effect.

Figure 5:
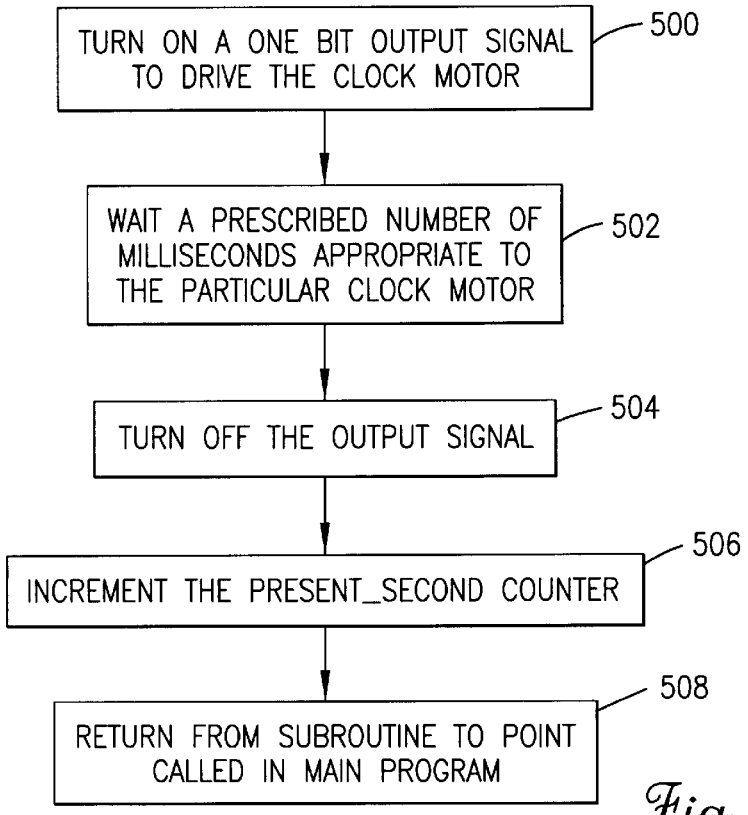
FIG. 5 is a flow diagram generally depicting the steps performed while operating the Step_Second subroutine of the time-keeping correction apparatus.

Step 308 calls the Step_Second Subroutine of FIG. 5. Step 500 turns on a one bit output signal to drive a slave time-keeper motor. Step 502 holds the one bit output signal on long enough to drive the particular slave time-keeper motor 180° for a 1 second advance in the position of the hands of the slave time-keeper 14. After the motor is driven for the 1 second advance, step 504 turns off the one bit output signal. Also, in the Step Second Subroutine, step 506 increments a Present_Second counter by 1. This incrementation of the Present_Second counter allows for the continued monitoring of the time shown by the position of the hands on the slave time-keeper 14. Step 508 returns control to the main program at step 308.

Step 310 reads the setting of the selector 36 to determine which correction scheme is used by the particular master time-keeper 12. Operationally, the time-keeping correction apparatus 22 allows for the handling of a plurality of different correction schemes such as a $59^{th}$ Minute correction scheme, a $58^{th}$ Minute correction scheme, and a National Time correction scheme. These various schemes convey correction information by applying a single voltage on and off in a particular pattern over several seconds of time. The selector 36 is set to account for the particular correction scheme offered by the master time-keeper 12. Step 312 chooses the particular correction scheme chosen from the plurality of correction schemes. From the particular setting of the selector 36, the controller 38 determines which particular algorithm is to be used in order to implement this particular scheme. The scheme path is depicted by step 314 or as any one of a plurality as step 320 depicts.

Before any scheme is implemented, step 316 or 322 read a one-bit port to determine if a correction during this one-second cycle is requested by the master time-keeper 12. If the one bit port is low, then no correction is required during this particular second. If no correction is required, the normal time-keeping loop is processed. If the condition of the one bit port is high, then a correction scheme is implemented through step 330 according to the correction scheme of the master time-keeper 12.

Step 318 performs the correction scheme process for a correction scheme 1. Step 324 performs the correction scheme process for correction scheme n, indicating that any one of a plurality of correction schemes might be chosen. At step 318 or step 324, the particular correction scheme determines how the controller 38 will proceed in its correction implementation.

Although correction scheme implementations vary, in one example, the pass counter is used. This pass counter increments the counter at one increment per pass. The definition of a pass is the cycle that is implemented every time the slave time-keeper proceeds one second. The pass counter continues to count as long as the 1 bit port that reflects the signal 26 from the master time-keeper 12 remains high. At the time that port goes low, the pass counter stops counting. At this point, the controller 38 observes the total count. If the count is less than 5 or greater than 20, the counter contents are deleted and no correction is performed, as the signal 26 is considered to be a mistake. If the count in the pass counter falls between 5 and 12, inclusive, this scheme from the master time-keeper 12 is indicating that a minutes correction is required. If the count on the pass counter was between 13–20, inclusive, then the correction scheme from the master time-keeper 12 indicates that an hours correction is required. In this manner, a duration of a voltage state of the master signal 26 is analyzed. Correction command flags inside the controller 38 are set accordingly. If correction is required, not only are these correction command flags set, but also variables for New_Hour, New_Minute and New_Second are set. For example, in one particular correction scheme, the master time-keeper issues a correction at 5:57:54 AM each day consisting of an on voltage lasting typically 14 seconds. Since the desired time after the 14 seconds is 5:58:08, the New_Hour variable that would be set would be 5, the New_Minute variable that would be set would be 58, and the New_Second variable that would be set would be 08.

Step 326 checks to see if the correction command flags are set. Again, if no correction command flags are set, in other words, the pass counter is not reading between 5–20 passes, inclusive, then the time-keeping correction apparatus 22 continues to keep time without performing a time correction in that cycle and loops from step 326 to step 328. If the correction command flags are set, then the time-keeping correction apparatus 22 proceeds to step 330.

Step 330 takes the New_Hour, New_Minute and New-Second values, which are absolute values known in the controller 38 because of the correction scheme implemented (such as 5, 58, and 08), and subtracts from those values the Present_Hour, Present_Minute and Present_Second values that are kept continuously up-to-date in memory in the time-keeping correction apparatus 22 from implementation of the Step_Second subroutine. Remember that, in this one example, the controller 38 is referring back to the pass counter recognizing that, if the pass counter was between 5–12 seconds, inclusive, then the pass counter is only looking for a correction to bring the slave time-keeper 14 up to the minute. If the pass counter had counted between 13–20, inclusive, then the master time-keeper 12 is telling the slave time-keeper 14 to bring the slave time-keeper time into correction up to the pre-set hour such as 5:58:08 AM. Again, the specifics on time correction are different according to the scheme implemented by the master time-keeper 12.

Step 330 performs the step of subtracting the Present_Hour, Present_Minute, Present_Second from the New_Hour, New_Minute, and New_Second, with the resulting new variables, Advance_Hours, Advance_Minutes, and Advance_Seconds. These new advance variables will instruct how far the hands of the slave time-keeper must be advanced.

After the determination of the new advance variables, step 332 calls the Step_Second subroutine.

As the hands are moved one second's worth (six angular degrees of the second hand), step 334 decrements the Advance_Seconds variable by one. Step 336 checks to see if the advance variables are zero. If they are, then the time correction is complete and the time-keeping correction apparatus 22 can return to its normal time-keeping operation. If the advance variables are not zero then the time correction continues.

In the preferred embodiment of the invention, the time-keeping correction apparatus 22 includes the ability to compensate for passage of time while a time correction sequence is being performed. This is needed because while the correction scheme implementing the time correction is being performed and the hands are advancing, time is also advancing. This embodiment also includes an input port 34 for receiving a master signal 26 representative of a time correction from the master time-keeper 12, correction software resident in the time-keeping correction apparatus 22 and including a code segment for representing a current position of hands of the slave time-keeper 14. This embodiment further includes circuitry including a controller 38 coupled with the input port 34 for analyzing the master signal 26 and the code segment, for calculating a quantity of time to advance slave time-keeper 14 time, for incrementing the quantity of the time to advance the slave time-keeper 14 in order to adjust for a passage of time during a correction cycle, and for developing a slave correction signal 28 representative of the quantity of time to be sent to the slave time-keeper 14. This embodiment also includes an output 40 coupled with the controller 38 for sending the slave correction signal 28 to the slave time-keeper 14. This embodiment may or may not include the selector 36 for permitting a user to select a correction scheme from among a plurality of correction schemes.

The advancing time is corrected completely in one correction cycle. When the Step_Second subroutine is called in the correction cycle at step 332, it must be realized that the subroutine at this point is cycling much faster than once per second because it is accelerating the hands of the slave time-keeper 14 to implement the time correction. Even though the hands are advancing faster than the normal time-keeping rate, step 338 still checks for an elapsed second flag. If the elapsed second flag is set, step 340 increments the Advance_Seconds variable by 1 to take into account that 1 more second has passed and therefore 1 more second has to be made up on the time correction. If the elapsed second flag is not set the Step_Second subroutine is called.

The correction software resident in the time-keeping correction apparatus 22 includes a code segment for representing a current position of hands of the slave time-keeper 14. The correction software updates the position of hands in the code segment. The correction software is preferably in the preferred controller, the micro controller (Microchip 16LC715-04/P).

The current position of the hands is remembered and updated without the use of mechanical sensors or stops. The current position of the hands of the slave time-keeper 14 is kept up to date in the Step_Second subroutine represented in FIG. 5. Step 506 increments the Present_Second Counter each time the hands are advanced by one second. If the new count in the Present_Second Counter is 60, then the Present_Second Counter will roll over to 0 and the Present_Minute Counter will be incremented. If the Present_Minute Counter is 60, then the Present_Minute Counter will roll over to 0 and the Present_Hour Counter will be incremented. If the Present_Hour Counter is 13, The Present_Hour counter rolls over to 1.

The clock system 10 may also include an advancement device coupled with the controller 38 for permitting a user to locally advance the slave time-keeper time. The advancement device is coupled with the controller 38 of the time-keeping correction apparatus 22 as illustrated in FIG. 2 as the Fast Travel Switch 42. Although the advancement device could be of many different types of devices, preferably, it is a push button switch soldered onto the printed circuit card and coupled with the controller 38 of the time-keeping correction apparatus 22. The advancement device is preferably disabled during the time period that the slave correction signal 28 is sent to the slave time-keeper 14.

Referring to flow diagram of FIG. 3, step 328 determines whether the advancement device has been activated. If the Fast Travel Switch 42 is pushed, the program does not wait for the next second but skips to step 308 and calls the "Step_Second" subroutine. If no correction command flags are set, the Fast Travel Switch 42 will continue to fast forward the slave time-keeper 14 by calling the Step_Second subroutine, until the user releases the Fast Travel Switch 42.

The master signal 26 representative of a time correction from the master time-keeper 12 may be any voltage signal. The preferred signal is a pulsed 24 volts alternating current signal.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the present invention, the following is claimed as new and desired to be secured by letters patent:

1. A self-adjusting clock system for providing a uniform time display throughout a facility, comprising:

a master time-keeper operable for keeping a correct time and operable for generating a master signal representative of a time correction;

a time-keeping correction apparatus coupled with the master time-keeper and operable to receive the master signal from the master time-keeper, to analyze the master signal, and to generate a slave correction signal, the time-keeping correction apparatus including a selector for permitting a user to select a correction scheme from among a plurality of correction schemes; and a plurality of slave time-keepers coupled with the time-keeping correction apparatus and operable to keep and display a slave time-keeper time and to respond to the slave correction signal to correct the slave time-keeper time when the slave time-keeper time deviates from the master time-keeper correct time.

2. The clock system as set forth in claim 1, wherein the time-keeping correction apparatus further includes an advancement device for permitting the user to locally advance the slave time-keeper time.

3. The clock system as set forth in claim 2, wherein the advancement device is disabled during a time period that the slave correction signal is sent to the slave time-keeper.

4. The clock system as set forth in claim 1, wherein the time-keeping correction apparatus includes a code segment for representing a current position of hands of the slave time-keeper.

5. The clock system as set forth in claim 4, further including circuitry for updating the position of the hands of the slave time-keeper in the code segment.

6. The clock system as set forth in claim 1, wherein the master signal is a voltage signal.

7. The clock system as set forth in claim 6, further including circuitry for analyzing a duration of a voltage state of the master signal.

8. The clock system as set forth in claim 1, wherein the slave time-keeper is an analog clock.

9. A time-keeping correction apparatus for correcting time of a slave time-keeper in accordance with a master time-keeper, comprising:

an input port for receiving a master signal representative of a time correction from the master time-keeper;

a selector for permitting a user to select a correction scheme from among a plurality of correction schemes;

circuitry coupled with the input port and the selector for analyzing the master signal in accordance with the selected correction scheme and for developing a slave correction signal to be sent to the slave time-keeper, and an output coupled with the circuitry for sending the slave correction signal to the slave time-keeper.

10. The apparatus as set forth in claim 9, further including an advancement device coupled with the circuitry for permitting the user to locally advance slave time-keeper time.

11. The apparatus as set forth in claim 10, wherein the advancement device is disabled during a time period that the slave correction signal is sent to the slave time-keeper.

12. The apparatus as set forth in claim 9, further including correction software resident in the apparatus and including a code segment for representing a current position of hands of the slave time-keeper.

13. The apparatus as set forth in claim 12, further including circuitry for updating the position of the hands of the slave time-keeper in the code segment.

14. The apparatus as set forth in claim 9, wherein the master signal is a voltage signal.

15. The apparatus as set forth in claim 14, further including circuitry for analyzing a duration of a voltage state of the master signal.

16. The apparatus as set forth in claim 9, wherein the slave time-keeper is an analog clock.

17. A time-keeping correction apparatus for correcting time of a slave time-keeper in accordance with a master time-keeper, comprising:

an input port for receiving a master signal representative of a time correction from the master time-keeper;

correction software resident in the apparatus and including a code segment for representing a current position of hands of the slave time-keeper;

circuitry coupled with the input port for analyzing the master signal and the code segment, for calculating a quantity of time to advance slave time-keeper time, for incrementing the quantity of the time to advance the slave time-keeper in order to adjust for a passage of time during a correction cycle, and for developing a slave correction signal representative of the quantity of time to be sent to the slave time-keeper; and an output coupled with the circuitry for sending the slave correction signal to the slave time-keeper.

18. The apparatus as set forth in claim 17, further including an advancement device coupled with the circuitry for permitting a user to locally advance the slave time-keeper time.

19. The apparatus as set forth in claim 18, wherein the advancement device is disabled during a time period that the slave correction signal is sent to the slave time-keeper.

20. The apparatus as set forth in claim 17, further including circuitry for updating the position of the hands of the slave time-keeper in the code segment.

21. The apparatus as set forth in claim 17, wherein the master signal is a voltage signal.

22. The apparatus as set forth in claim 21, further including circuitry for analyzing a duration of a voltage state of the master signal.

23. The apparatus as set forth in claim 17, wherein the slave time-keeper is an analog clock.

* * * * *